US009429175B2

(12) United States Patent
Coolidge

(10) Patent No.: US 9,429,175 B2
(45) Date of Patent: Aug. 30, 2016

(54) PRESSURE COMPENSATED HYDRAULIC SYSTEM HAVING DIFFERENTIAL PRESSURE CONTROL

(75) Inventor: Gregory T. Coolidge, Elyria, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 961 days.

(21) Appl. No.: 13/697,473

(22) PCT Filed: May 11, 2011

(86) PCT No.: PCT/US2011/036047

§ 371 (c)(1),
(2), (4) Date: Feb. 28, 2013

(87) PCT Pub. No.: WO2011/143301

PCT Pub. Date: Nov. 17, 2011

(65) Prior Publication Data

US 2013/0146162 A1 Jun. 13, 2013

Related U.S. Application Data

(60) Provisional application No. 61/333,389, filed on May 11, 2010.

(51) Int. Cl.
*F15B 21/06* (2006.01)
*F15B 11/16* (2006.01)

(52) U.S. Cl.
CPC ..... *F15B 21/06* (2013.01); *F15B 11/163* (2013.01); *F15B 11/165* (2013.01); *F15B 2211/20553* (2013.01); *F15B 2211/30555* (2013.01); *F15B 2211/653* (2013.01); *Y10T 137/85986* (2015.04)

(58) Field of Classification Search
CPC F15B 11/165; F15B 2211/605; F15B 21/06; F15B 11/168
See application file for complete search history.

(56) References Cited

U.S. PATENT DOCUMENTS 3,754,400 A 8/1973 Parquest
3,826,090 A 7/1974 Bahl
(Continued)

FOREIGN PATENT DOCUMENTS

DE 102 14 089 11/2002
EP 0 432 266 4/1991
(Continued)

*Primary Examiner* — Thomas E. Lazo
*Assistant Examiner* — Abiy Teka
(74) *Attorney, Agent, or Firm* — Renner, Otto, Boisselle & Sklar, LLP

(57) ABSTRACT

A hydraulic control valve assembly (10), method and system, characterized by control valves (26) each having a variable metering orifice; a compensator (28) that controls flow of fluid from the variable metering orifice to a work port (A,B) in response to a differential in pressures acting on opposite first and second sides of the compensator, wherein a first side receives a pressure at the downstream side of the variable metering orifice; a load sense passage (34) providing a load sense pressure; and a differential pressure controller (40) having a first inlet connected to a pump supply port and a second inlet connected to the load sense passage, the controller having a first operational mode in which load sense pressure at the second inlet is supplied to an outlet of the controller and a second operational mode in which flow from the first inlet is metered to the outlet of the controller to provide a differential control output pressure, and wherein an outlet of the differential pressure controller is connected to a pump control port and/or to the second side of the pressure compensating valve of at least one of the control valves.

21 Claims, 6 Drawing Sheets

(56) References Cited

U.S. PATENT DOCUMENTS

| | | | | |
|---|---|---|---|---|
| 3,945,175 | A | 3/1976 | Barkstrom et al. | |
| 5,027,846 | A | 7/1991 | Baron | |
| 5,046,311 | A | 9/1991 | Cartner | |
| 5,056,312 | A | 10/1991 | Hirata et al. | |
| 5,058,626 | A | 10/1991 | Takaoka et al. | |
| 5,062,350 | A | 11/1991 | Tanaka et al. | |
| 5,186,000 | A | 2/1993 | Hirata et al. | |
| 5,259,192 | A * | 11/1993 | Karakama | E02F 9/2225 60/422 |
| 5,267,440 | A | 12/1993 | Nakamura et al. | |
| 5,469,646 | A | 11/1995 | Takamura | |
| 5,528,911 | A | 6/1996 | Roth et al. | |
| 5,873,245 | A | 2/1999 | Kato et al. | |
| 5,894,860 | A | 4/1999 | Baldauf et al. | |
| 5,996,628 | A | 12/1999 | Najmolhoda et al. | |
| 6,098,403 | A | 8/2000 | Wilke | |
| 6,318,079 | B1 * | 11/2001 | Barber | F15B 11/163 60/422 |
| 6,408,876 | B1 | 6/2002 | Nishimura et al. | |
| 6,644,350 | B1 | 11/2003 | Douglass et al. | |
| 6,692,396 | B1 | 2/2004 | Grogg et al. | |
| 6,860,293 | B2 | 3/2005 | Douglass et al. | |
| 6,895,852 | B2 | 5/2005 | Pieper | |
| 7,389,968 | B2 | 6/2008 | Katoh et al. | |
| 2001/0032677 | A1 | 10/2001 | Bogdanowicz | |

FOREIGN PATENT DOCUMENTS

| | | |
|---|---|---|
| EP | 423 353 | 4/1991 |
| EP | 0 537 369 | 4/1993 |
| EP | 0 538 243 | 4/1993 |
| EP | 0 715 031 | 6/1996 |
| EP | 0 791 694 | 8/1997 |
| EP | 1 783 378 | 5/2007 |

* cited by examiner

PRESSURE COMPENSATED HYDRAULIC SYSTEM HAVING DIFFERENTIAL PRESSURE CONTROL

RELATED APPLICATION

This application is a national phase of International Application No. PCT/US2011/036047 filed May 11, 2011 and published in the English language which claims the benefit of U.S. Provisional Application No. 61/333,389 filed May 11, 2010, each of which is hereby incorporated herein by reference in its entirety.

FIELD OF THE INVENTION

The present invention relates to hydraulic systems. More particularly, the present invention relates to hydraulic systems for work vehicles and especially hydraulic systems that are compensated to regulate pressure differentials existing across metering orifices of control valves within the hydraulic systems.

BACKGROUND OF THE INVENTION

Hydraulic systems are employed in many circumstances to provide hydraulic power from a hydraulic power source to multiple loads. In particular, such hydraulic systems are commonly employed in a variety of work vehicles such as excavators and loader-backhoes. In such vehicles, the loads powered by the hydraulic systems may include a variety of hydraulically actuated devices such as piston-cylinder assemblies that lower, raise and rotate arms, and lower and raise buckets, as well as hydraulically-powered motors that drive tracks or wheels of the vehicles. Although the various hydraulically actuated devices typically are powered by a single source (e.g., a single pump), the rates of fluid flow to the different devices typically are independently controllable, through the use of separate control valves (typically spool valves) that are independently controlled by an operator of the work vehicle.

The operation of the hydraulically actuated devices depends upon the hydraulic fluid flow to those devices, which in turn depends upon the cross-sectional areas of metering orifices of the control valves between the pressure source and the hydraulically actuated devices, and also upon the pressure differentials across those metering orifices.

To facilitate control, hydraulic systems often are pressure compensated, that is, designed to set and maintain the pressure differentials across the metering orifices of the control valves, so that controlling of the valves by an operator only tends to vary the cross-sectional areas of the orifices of those valves but not the pressure differentials across those orifices. Such pressure compensated hydraulic systems typically include pressure compensation valves positioned between the respective control valves and the respective hydraulically actuated devices. The pressure compensation valves control the pressures existing on the downstream sides of the metering orifices to produce the desired pressure differentials across the metering orifices.

Such pressure-compensated hydraulic systems normally ensure that the same particular pressure differential (e.g., a pump margin pressure) occurs across each of the control valves. Nevertheless, it may be desirable in some hydraulic systems to have a lower pressure differential across selected valves to reduce the hydraulic fluid flow through those valves. For example, in the case of an excavator, it may be desirable to provide normal hydraulic fluid flow to the cylinders that control lifting or other movement of an arm or bucket of the excavator, or to accessories of the excavator such as a trenching device, yet at the same time desirable to provide reduced hydraulic fluid flow to the hydraulic motors controlling the speeds of the tracks of the excavator so that the excavator travels at reduced speeds. Therefore, there is a need in some hydraulic systems to provide a pressure differential across metering orifices in selected control valves which is less than the pressure differential across other control valves.

This capability of providing adjustable control of the pressure differentials across multiple control valves in an even manner is desirable in many circumstances, since it is often desirable that multiple hydraulic devices of a hydraulic system should receive precisely identical amounts of hydraulic fluid flow when an operator sets the respective control valves identically. For example, with respect to the excavator discussed above, it would be desirable that the hydraulic motors corresponding to the left and right tracks of the excavator be driven at the exact same speed assuming that the operator of the excavator set the control valves for those motors to the same level.

U.S. Pat. No. 6,895,852 discloses an apparatus having a valve assembly with pressure compensated valve sections. The apparatus includes an adjustable pressure reducing valve that communicates pressure from a source (e.g., a pump) to the particular compensation valves that are coupled to the control valves for which adjustable control is desired. The opposing actuation ports of the adjustable pressure reducing valve are coupled, respectively, to the pressure applied to those particular compensation valves and to the highest load pressure plus an adjustment spring pressure. Consequently, the pressure applied to the particular compensation valves exceeds that of the highest load pressure by the adjustment spring pressure, which results in reduced pressure differentials across the control valves associated with those compensation valves. Because the adjustable pressure reducing valve is in communication with each of the particular compensation valves that are coupled to the control valves for which adjustable control is desired, and because the single adjustment spring pressure determines the operation of that adjustable pressure reducing valve, an operator only needs to make a single adjustment to the single adjustment spring pressure to produce the same changes to the pressure differentials across each of the control valves for which adjustable control is desired. Also disclosed is the use of another valve that is coupled between the adjustable pressure reducing valve, the highest load pressure and the particular compensation valves of interest. The reduction in the pressure differentials produced by the adjustable pressure reducing valve can be switched on and off by alternatively coupling the particular compensation valves to the output of the adjustable pressure reducing valve and to the highest load pressure, respectively.

SUMMARY OF THE INVENTION

The present invention provides a pressure compensated hydraulic system having differential pressure control that enables fluid flow through one or more valve sections to be adjusted, as may be in many applications. One or more principles of the invention may be applied to load sense and post-pressure compensated valves.

In accordance with the invention, a differential pressure controller (e.g. a differential pressure control valve) senses maximum regulated pressure (e.g. load sense pressure) downstream of one or more pressure compensating valves each associated with a respective control valve (or valves) that has a variable metering orifice through which hydraulic fluid flows between an inlet port providing for connection to a pump and a respective work port providing for connection to a respective actuator (e.g. a hydraulically actuated device such as a piston-cylinder assembly, hydraulic motor, etc.). The differential pressure controller produces an output pressure that may be supplied to a pump control port to which can be connected the control port of a variable displacement pump that produces an output pressure of the pump that is a predefined amount greater than the pressure supplied to the control port of the pump. Additionally or alternatively the output pressure of the differential pressure controller may be supplied to the pressure compensating valve of at least one of the control valves. The output pressure may be equal to the sum of the maximum regulated pressure (e.g., the load sense pressure) and a setting pressure of the differential pressure controller.

Accordingly, the differential pressure controller may supply an output pressure that is higher than the maximum regulated or load sense pressure to either or both the pump port and a work section compensator spring chamber to change a pressure differential. Consequently, either the inlet pressure and/or pressure downstream of the work section flow output controlling area increases. In other words, the system enables the hydraulic pressure differential between the control valve inlet and the work section with the highest work port pressure and/or across one or more work section flow areas to vary flow output of the control valve.

Hence, according to one aspect of the invention, a hydraulic control valve assembly comprises plural control valves each having a variable metering orifice through which hydraulic fluid flows between an inlet port providing for connection to a pump and a respective work port providing for connection to a respective actuator; a compensator that controls flow of fluid from the variable metering orifice to the work port of each control valve in response to a differential in pressures acting on opposite first and second sides of the compensator, wherein the first side receives a pressure at the downstream side of the variable metering orifice; a load sense passage connected to the control valves to provide a load sense pressure corresponding to the greatest pressure amongst the work ports; and a differential pressure controller having a first inlet connected to the pump supply port and a second inlet connected to the load sense passage, the differential pressure controller having a first operational mode in which load sense pressure at the second inlet is supplied to an outlet of the differential pressure controller and a second operational mode in which flow from the first inlet is metered to the outlet of the differential pressure controller to provide a differential control output pressure at the outlet of the differential pressure controller, and wherein the outlet of the differential pressure controller is connected to (a) a pump control port to which can be connected the control port of a variable displacement pump that produces an output pressure of the pump that is a predefined amount greater than the pressure supplied to the control port of the pump, and/or (b) to the second side of the pressure compensating valve of at least one of the plural control valves.

Each control valve may have a respective compensator, and each compensator that is not connected to the outlet of the differential pressure controller, has the second side connected to load sense passage.

The differential pressure controller may be configured to provide a differential control output pressure that is greater than the load sense pressure.

The differential pressure controller may include a controller valve that in the second operational mode provides a pressure drop corresponding to a control force applied to the controller valve. In a particular embodiment, the control force is selected to provide a predetermined pressure difference between the differential control output pressure and the load sense pressure.

The control force may be provided by a control device that may be configured to provide different control forces during shifting of the differential pressure controller between its first and second operation modes.

The controller valve is biased to a position corresponding the first operation mode.

According to another aspect of the invention, a method of controlling a hydraulic system wherein plural control valves each have a variable metering orifice through which hydraulic fluid flows between an inlet port providing for connection to a pump and a respective work port providing for connection to a respective actuator, comprises the steps of using a compensator to control flow of fluid from the variable metering orifice to the work port of each control valve in response to a differential in pressures acting on opposite first and second sides of the compensator, wherein the first side receives a pressure at the downstream side of the variable metering orifice; providing a load sense pressure corresponding to the greatest pressure amongst the work ports; and using a differential pressure controller having a first inlet connected to the pump supply port and a second inlet connected to the load sense passage, the differential pressure controller having a first operational mode in which load sense pressure at the second inlet is supplied to an outlet of the differential pressure controller and a second operational mode in which flow from the first inlet is metered to the outlet of the differential pressure controller to provide a differential control output pressure at the outlet of the differential pressure controller, and wherein the outlet of the differential pressure controller is connected to (a) a pump control port to which can be connected the control port of a variable displacement pump that produces an output pressure of the pump that is a predefined amount greater than the pressure supplied to the control port of the pump, and/or (b) to the second side of the pressure compensating valve of at least one of the plural control valves.

According to a further aspect of the invention, a valve assembly comprises multiple working sections, each working section having a movable control spool and a compensator, an input conduit for supplying fluid to the working sections, a load sense conduit adapted to receive a pressure signal from the working section outputting a highest pressure, and a control mechanism connected to the input conduit and the load sense conduit and provide an output pressure in response to actuation of an associated input.

The associated input may be a proportional solenoid, and/or the output pressure may be provided to one of a pump, a pressure gain mechanism, or a compensator of at least one of the working sections.

A control valve assembly employing a control mechanism according to the present invention has numerous applications. For example, with reference to a mini-excavator such as those often available for rental, a device that is actuatable by an operator for either increasing or decreasing fluid flow through one or more sections of a valve assembly may allow the mini-excavator to have multiple operating modes. In one example, the mini-excavator may have a novice operating mode and an expert operating mode, where selection of the operating mode is provided by a switch within a cab of the mini-excavator. Actuation of the switch into the novice operating mode operates to slow the speed associated with each function of the mini-excavator; whereas actuation of the switch into the expert operating mode operates to increase the speed associated with each function of the mini-excavator as compared to the speed in novice mode.

Further features and advantages of the invention will become apparent from the following detailed description when considered in conjunction with the drawings.

DETAILED DESCRIPTION

Figure 1:
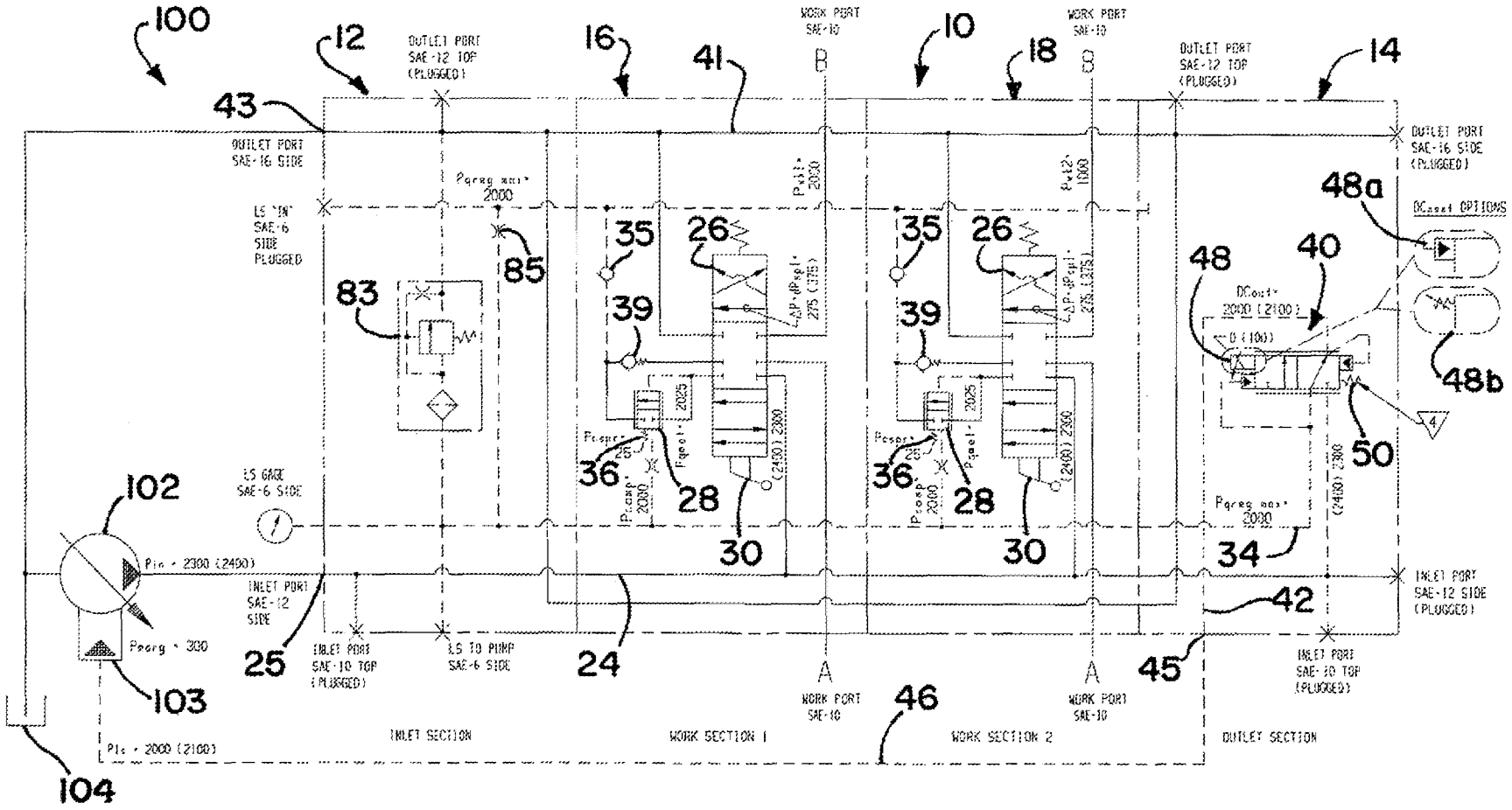
FIG. 1 is schematic diagram showing an exemplary hydraulic system according to the present invention, where a differential pressure controller is used to provide flow boost for all work sections.

FIG. 1 illustrates a valve assembly 10 having multiple valve sections. The valve assembly 10 of FIG. 1 includes an inlet section 12, an outlet section 14, and two working sections 16 and 18. In FIG. 1, the two working sections 16 and 18 are interposed between the inlet section 12 and the outlet section 14. Although FIG. 1 illustrates a valve assembly 10 with only two working sections located between the inlet section and the outlet section, any number of working sections may be provided.

The valve assembly 10 forms a portion of a hydraulic system 100. The hydraulic system 100 also includes a variable displacement hydraulic pump 102, a reservoir 104, and hydraulically actuated devices (not shown) (also herein referred to as actuators), one of which is associated with each working section 16 and 18 of the valve assembly 10. The hydraulically actuated devices may be piston-cylinder assemblies, hydraulic motors, etc. The hydraulically actuated devices may be those used to lower, raise and rotate arms, lower and raise buckets, or to power drive tracks or wheels of vehicles, in particular excavators.

The hydraulic pump 102 is responsive to a pressure signal at load sense port 103 for controlling a pressure at its outlet port. For example, the hydraulic pump 102 may be designed to provide a 300 psi margin pressure. In such an example, the hydraulic pump 102 is operable to maintain an outlet pressure that is 300 psi greater than the received pressure. The pump 102 adjusts its displacement so as to maintain the margin pressure based outlet pressure.

In other embodiments, other types of load sensing margin pressure sources may be used. For example, a fixed displacement pump may be used with a bypass valve that modulates flow bypassed back to the reservoir in response to a pressure signal, whereby the pressure supplied at the outlet of the pressure source maintains a pressure that is greater than the pressure signal by a prescribed amount. Such a load sensing margin pressure source may be used interchangeably with the herein illustrated load sensing margin pressure sources using variable displacement pumps.

The outlet port of the hydraulic pump 102 is in fluid communication with the inlet section 12 of the valve assembly 10. An inlet conduit 24 of the valve assembly 10 includes an inlet port 25 preferably located in the inlet section 12. The inlet conduit 24 extends through the inlet section 12, through each working section 16 and 18, and into the outlet section 14 of the valve assembly 10.

Each of the working sections 16 and 18 of the valve assembly 10 includes an associated control spool 26 and an associated compensator 28. In the embodiment illustrated in FIG. 1, the compensator 28 of each working section 16 and 18 is located downstream of the control spool 26 relative to the inlet conduit 24. Thus, FIG. 1 illustrates post-pressure compensated working sections.

The inlet conduit 24 provides fluid to the control spool 26 of each working section 16 and 18. The control spools 26 are independently actuatable to move from a neutral, closed position to a position for directing hydraulic fluid toward the compensator 28 of the associated working section. FIG. 1 schematically illustrates handles 30 mechanically linked to each of the control spools 26 for moving the control spools in response to operator inputs. Alternatively, the control spools 26 may be moved via an indirect linkage so that the operator may be positioned remote from the valve assembly. As will be appreciated by those skilled in the art, other means may be used to control movement of the spool, including electrically actuated members such as a solenoid that may be pulse width modulated in response to movement of a control member located, for example, in the cab of a vehicle.

In response to movement of a control spool 26 of a working section 16 and 18, fluid flows from the inlet conduit 24 across the control spool 26 and into a metered cavity of the working section located immediately upstream of the compensator 28. A pressure drop occurs as the fluid passes across the control spool 26 to the metered cavity.

The compensator 28 of each working section 16 and 18 is adapted to maintain a set pressure drop within the working section. The set pressure drop is related to a received pressure signal, commonly called a load sense signal. As illustrated in FIG. 1, each compensator 28 receives the load sense signal from a load sense conduit 34. The load sense signal corresponds to the highest working pressure from the work ports of the valve assembly 10.

Thus, with reference to the exemplary embodiment of FIG. 1, the load sense signal will equal 2000 psi, which is the pressure in the work port of working section 16 that is being supplied with fluid. Load sense check valves 35 in the working sections of the valve assembly 10 are arranged such that the highest work port pressure is provided into the load sense conduit 34.

In addition to receiving the load sense signal from the load sense conduit 34, each compensator 28 also includes a spring 36 having a preset spring force for biasing a poppet of the compensator 28 into a closed position, as is illustrated schematically in FIG. 1. Thus, the pressure applied by the spring 36 is added to the pressure applied by the load sense signal for biasing the compensator 28 into a closed position. The compensator 28 is opened in response to the fluid pressure in the metered cavity increasing to a value which is greater than the sum of the spring pressure and load sense signal. When the compensator 28 is opened, fluid flows past the poppet of the compensator and to a work port of the associated working section of the valve assembly 10 preferably via a load check valve 39. In the embodiment of FIG. 1, both working sections 16 and 18 have identical configurations. Each working section has respective work ports A and B that provide for connection to inlet/outlet ports of a hydraulically actuated device whereby fluid can be supplied to and returned from the device. Return flow is directed to an outlet conduit 41 extends through the inlet section 12, through each working section 16 and 18, and into the outlet section 14 of the valve assembly 10. The outlet conduit 41 is connected to an outlet port 43 that provides for connection to the reservoir 104 or directly to the inlet of the pump 102.

The outlet section 14 of the valve assembly 10 according to the embodiment of FIG. 1 also receives fluid from the inlet conduit 24. The outlet section 14 further includes a differential pressure control mechanism 40, herein also referred to as a differential pressure controller. In the embodiment of FIG. 1, the control mechanism 40 is operable for controlling fluid pressure to a control conduit 42 that leads to a control port 45 which connected by a line 46 to the load sense port 103 of the pump 102. The control mechanism 40 is adapted to receive pressure from two inputs: (i) the load sense conduit 34 and (ii) the input conduit 24. The control conduit 42 in FIG. 1 provides a pressure signal to the load sense port of the pump 102 that is the basis for controlling the outlet pressure of the pump. More specifically, the pump 102 attempts to maintain an outlet pressure that exceeds the pressure in the control conduit 42 by the margin pressure.

The control mechanism 40 includes a first position, illustrated schematically in FIG. 1, in which the load sense conduit 34 is in communication with the control conduit 42. When the control mechanism 40 is in the first position, there is no pressure drop (or only a negligible pressure drop) across the control mechanism 40 and, the load sense signal pressure from the load sense conduit 34 is transferred to the control conduit 42. As a result, the pump 102 operates to provide an outlet pressure that exceeds the load sense signal pressure by the margin pressure.

The control mechanism 40 moves in response to a controlled input from the first position to a position in which the input conduit 24 is in communication with the control conduit 42. The pressure drop across the control mechanism 40 may be controlled when the input conduit 24 is in communication with the control conduit 42. For example, in one embodiment, the controlled input is provided by an input device 48 such as a proportional solenoid (or a hydraulic or pneumatic pressure source 48*a* either within the hydraulic system or separate from the hydraulic system, an adjustable spring mechanism 48*b*, or a stepper motor or similar device) that is adapted to adjust the pressure drop across the control mechanism 40, for example in the range of 0 to 300 psi. A return spring 50 may act to return the control mechanism 40 to the first position in the absence of a higher force from the proportional solenoid 48 or other input device. Additional alternatives for the controlled input may include an adjustable pressure input from a hydraulic or pneumatic pressure source either within the hydraulic system or separate from the hydraulic system, an adjustable spring mechanism, or a bi-directional pilot valve, stepper motor or similar devices that avoid the need for the return spring, or similar devices in general. The input device may be controlled by a suitable controller such as a microprocessor, programmable controller or the like, with one or more inputs, such as a selector input for enabling selection between different modes of operation of the control mechanism. The controller may have other inputs for receiving signals from one or more sensors that report system pressures, fluid flows, states, etc. to the controller. This may include end-of-stroke sensors for use in connection with one or more of the different embodiments for automatic cylinder speed reduction at the end of stroke, as discussed further below. The controller may also provide for proportional control of the controlled input for providing desired functionality. The controller may even simply be a mode selector switch.

During operation of the hydraulic system 100 of FIG. 1 with the control mechanism 40 in its illustrated position (i.e., the first position corresponding to a first operational mode), pressure from the load sense conduit 34 is provided to the control conduit 42 without a pressure drop (or with a negligible pressure drop) and, the pump 102 attempts to maintain an outlet pressure equal to the load sense pressure plus the margin pressure. Depending upon the pressure drop across the control spool 26 and the compensator 28 of each working section 16 and 18, fluid flows across the control spool and the compensator to a working port of the associated working section for actuating the associated hydraulically actuatable device.

For example, assume that working section 16 is actuated for providing fluid at 2000 psi to its working port B and working section 18 is actuated for providing fluid at 1000 psi to its working port B. The load sense signal pressure, i.e., the highest working port pressure, will be 2000 psi. With the control mechanism 40 in the first position, as illustrated in FIG. 1, the 2000 psi load sense signal pressure is provided to the control conduit 42 and to the pump 102. The pump 102 applies its margin pressure to the pressure received from the control conduit 42 and, as a result, attempts to maintain an output pressure of 2300 psi (when the margin pressure is 300 psi). In this example, with reference to working section 16, the pressure drop across the control spool and the compensator equals 300 psi for providing 2000 psi to working port B.

Now, assume that the proportional solenoid 48 is actuated and the control mechanism 40 shifts to a position for connecting the inlet conduit 24 to the control conduit 42, this corresponding to a second operational mode. When first actuated, the proportional solenoid 48 controls the control mechanism 40 to provide a first pressure drop between the inlet conduit 24 and the controlled conduit 42. The proportional solenoid 48 then adjusts the pressure drop across the control mechanism 40 to provide the desired pressure in the control conduit 42.

For example, still assume that working section 16 is actuated for providing fluid at 2000 psi to its working port B and working section 18 is actuated for providing fluid at 1000 psi to its working port B. The proportional solenoid 48 controls the control mechanism 40 for providing the desired pressure in the control conduit 42. In this example, assume that the desired pressure in the control conduit 42 is 2100 psi (100 psi higher than the load sense signal pressure). Thus, when initially actuated, the proportional solenoid 48 controls the control mechanism 40 to provide a 200 psi pressure drop (2300 psi pump outlet pressure to the 2100 psi control conduit 42 pressure). In response to the 2100 psi pump control conduit pressure, the pump 102 applies its margin pressure to attempt to maintain an outlet pressure of 2400 psi. As the pump outlet pressure increases to 2400 psi, the proportional solenoid 48 adjusts to increase the pressure drop across the control mechanism 40 to 300 psi for maintaining the 2100 psi pressure in the control conduit 42. In response to the pump outlet pressure increasing to 2400 psi, the pressure drop across the control spool 26 of each working section 16 and 18 increases (in this example, the pressure drop increases by 100 psi as the pump outlet pressure increases from 2400 psi to 2300 psi). As a result of the increase pressure drop across the control spool 26 of each working section 16 and 18, flow to the associated hydraulically actuated devices increases and thus, the actuation speed of the associated hydraulically actuated devices increases.

As will be appreciated, the hydraulic system shown in FIG. 1 has particular application to a mini-excavator such as those often available for rental. The differential pressure controller can be energized to allow for increased fluid flow and de-energized for decreased flow. In one example, the mini-excavator may have a novice operating mode and an expert operating mode, where selection of the operating mode is provided by a switch within a cab of the mini-excavator. Actuation of the switch into the novice operating mode operates to slow the speed associated with each function of the mini-excavator; whereas actuation of the switch into the expert operating mode operates to increase the speed associated with each function of the mini-excavator as compared to the speed in novice mode.

Before leaving FIG. 1, it is noted that hydraulic system 100/valve assembly 10 may be provided with other operational components that are typically employed in similar types of valves as known to those skilled in the art. For example, the valve assembly may include a load sense pressure relief valve 83 that dumps hydraulic fluid to the reservoir 104 if the load sense pressure exceeds a prescribed amount. Associated with the relief valve 83 is an orifice 85 that limits flow to the load sense relief valve and provides dampening. The relief valve may be conveniently located in the inlet section 12. The valve assembly 10 may also be provided in a conventional manner with a bleed orifice for decaying load sense pressure to reservoir pressure when the work sections are deactivated to let the system go to a low pressure standby mode, as is known in the art.

Figure 2:
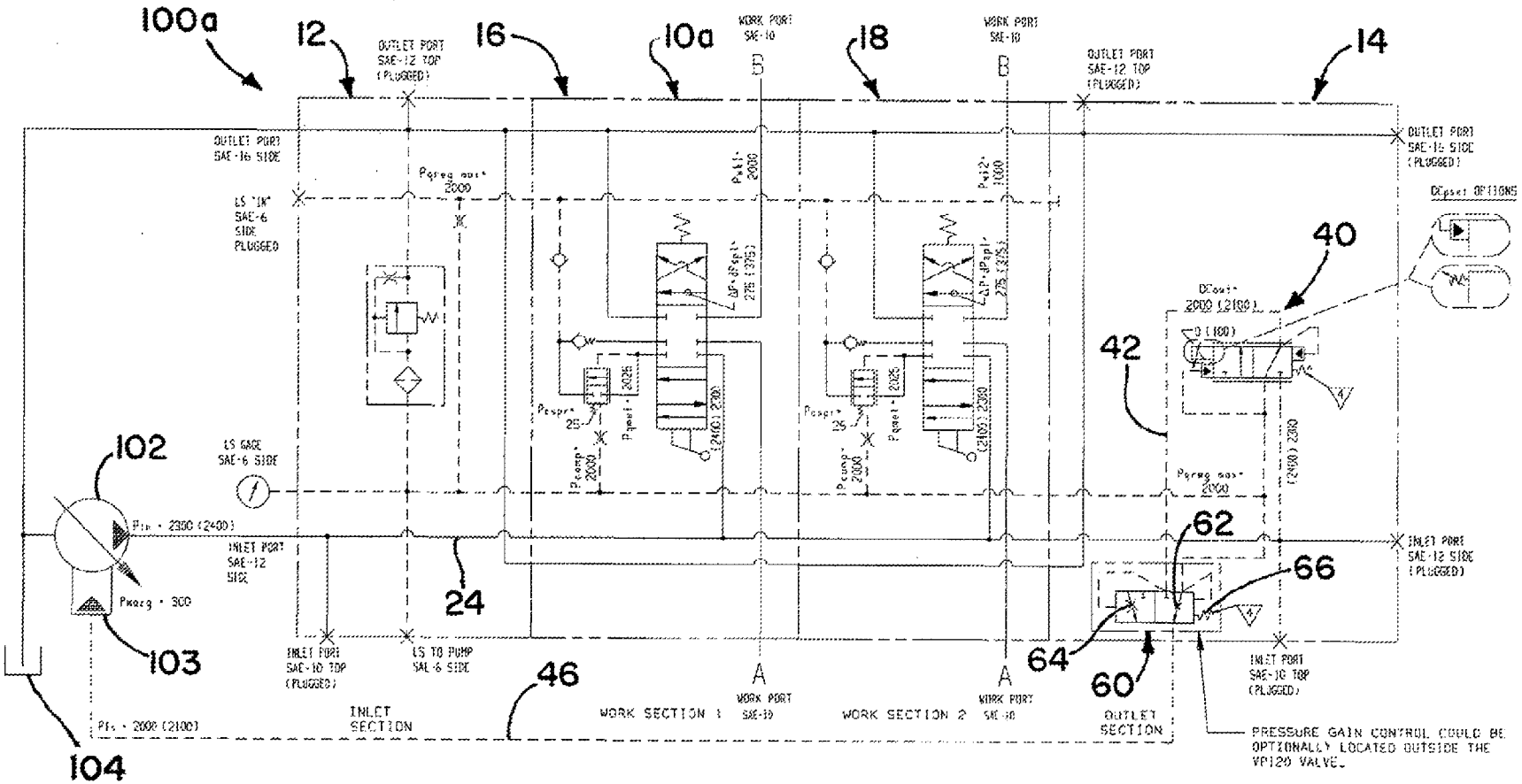
FIG. 2 is schematic diagram showing another exemplary hydraulic system according to the present invention, where the differential pressure controller is used to where the differential pressure controller provides flow boost and a gain adjustment mechanism for slowing response of a controlled actuator.

The valve assembly 10*a* of FIG. 2 is the same as that of FIG. 1 except for a pressure gain mechanism 60 provided in conduit 42 for receiving the outlet pressure of the differential pressure controller 40. The pressure gain mechanism 60 is a two-position mechanism having a first flow orifice 62 associated with a first position and a second flow orifice 64 associated with a second position. The second flow orifice 64 is sized larger than the first flow orifice 62 and therefore, provides a lower pressure drop than the first flow orifice. The pressure gain mechanism 60 is biased into a first position by a return spring 66. The pressure gain mechanism 60 is adapted to shift from the first position to a second position in response to an increase in pressure in conduit 42. The pressure gain mechanism 60, when located in its first position, acts to restrict flow from conduit 42 so as to slow the responsiveness of the pump 102. In response to an input to the control mechanism 40 by the proportional solenoid 48, the gain mechanism 60 moves from the first to the second position whereby the gain mechanism is less restrictive to flow in the conduit 42 so as to quicken the responsiveness of pump 102 to change pressure. In this (expert) mode, both the response to build pressure and work section flow output/actuator speed increase. In the other (novice) mode, the response will be less than in the expert mode. It is noted that in another embodiment the gain control mechanism can be shifted between its two states other than by means of the output of the differential pressure controller, such as by means of a programmable processor or other controller, or simply by a mode selector switch.

In the FIG. 2 embodiment, pressure gain control and differential pressure control work together, for example, to assist a novice operator with more forgiving operation. For the novice, differential pressure control will limit the machine's maximum function speed while pressure gain control cushions the fast reaction of machine controls. As a result, a mini-excavator can be suitable for use by either a novice or expert operator.

Figure 3:
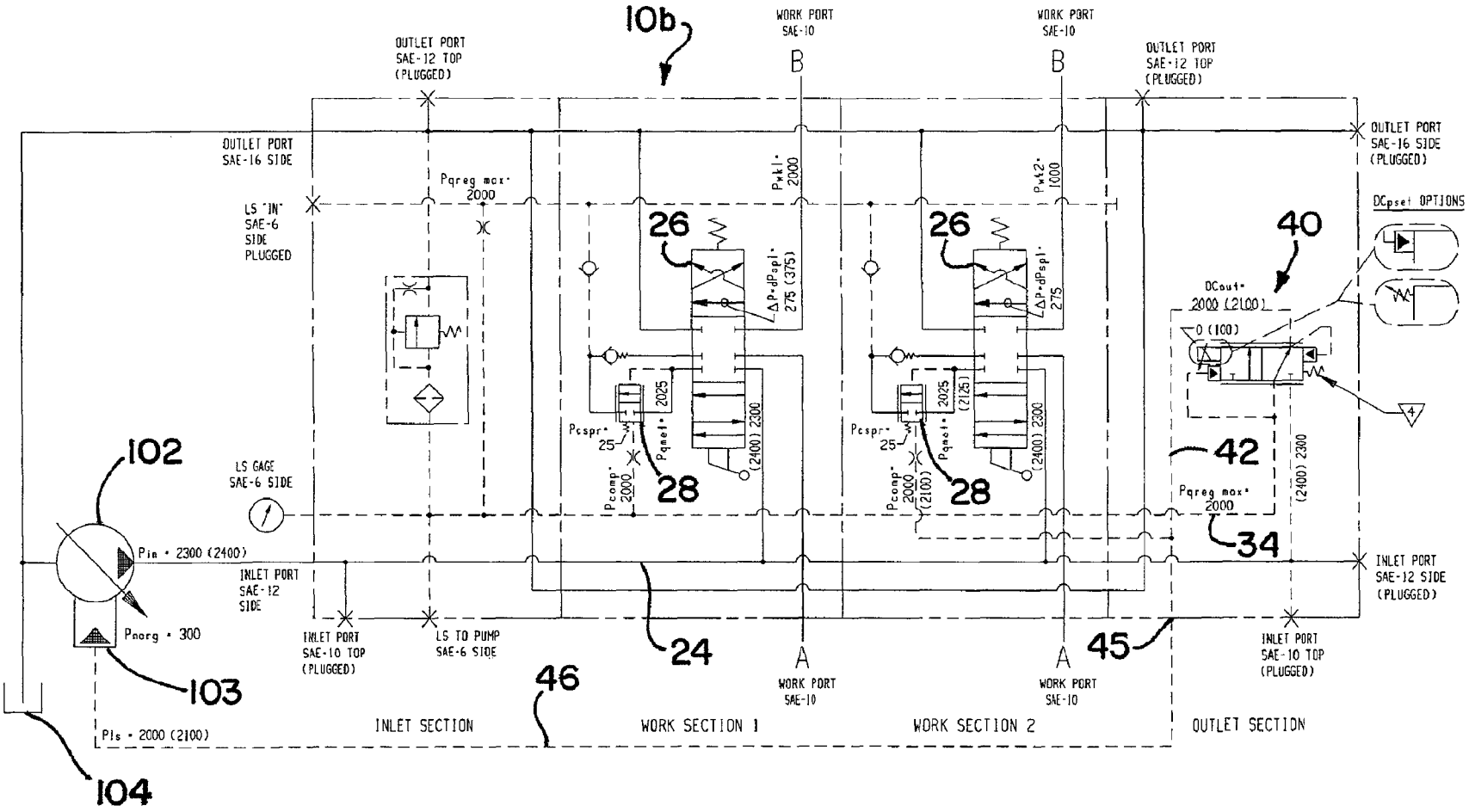
FIG. 3 is schematic diagram showing still another exemplary hydraulic system according to the present invention, where the differential pressure controller is used to boost output flow of one or more of the work sections with low differential pressure default.

Another embodiment is shown in FIG. 3 which is the same as the FIG. 1 embodiment except as noted below or is otherwise evident from the figure. In the FIG. 3 embodiment, the compensator 28 of working section 16 receives the load sense signal from load sense line 24, while the compensator 28 of working section 18 receives the pressure signal output from the control mechanism 40 to the control conduit 42. In response to the proportional solenoid 48 (or other input to the control mechanism 40) being actuated to modify the pressure provided to the pump, the pressure drop within working section 16 increases, while the pressure drop in working section 18 remains constant. This design provides priority to working section 16 having the greater pressure drop. As a result of the increased pressure drop, more flow is provided to the hydraulically actuated device associated with working section 16. As a result, the actuation speed of the hydraulically actuated device associated with working section 16 increases.

Although FIG. 3 illustrates only one working section 18 receiving the output from the control mechanism 40, any number of working sections may receive this output. The configuration of FIG. 3 may be used, in one example, in a mini-excavator with one working section associated with the swing and another working section associated with the boom. As a result, when the proportional solenoid 48 is actuated to boost the pressure provided to the control conduit 42, the pressure drop associated with the working section associated with the swing may be increased so that the swing function receives increased flow for increasing the speed of actuation. At the same time, the pressure drop associated with the working section associated with the boom remains constant whereby the boom function acts in the same manner as it did prior to actuation of the proportional solenoid 48 (or other input).

Figure 4:
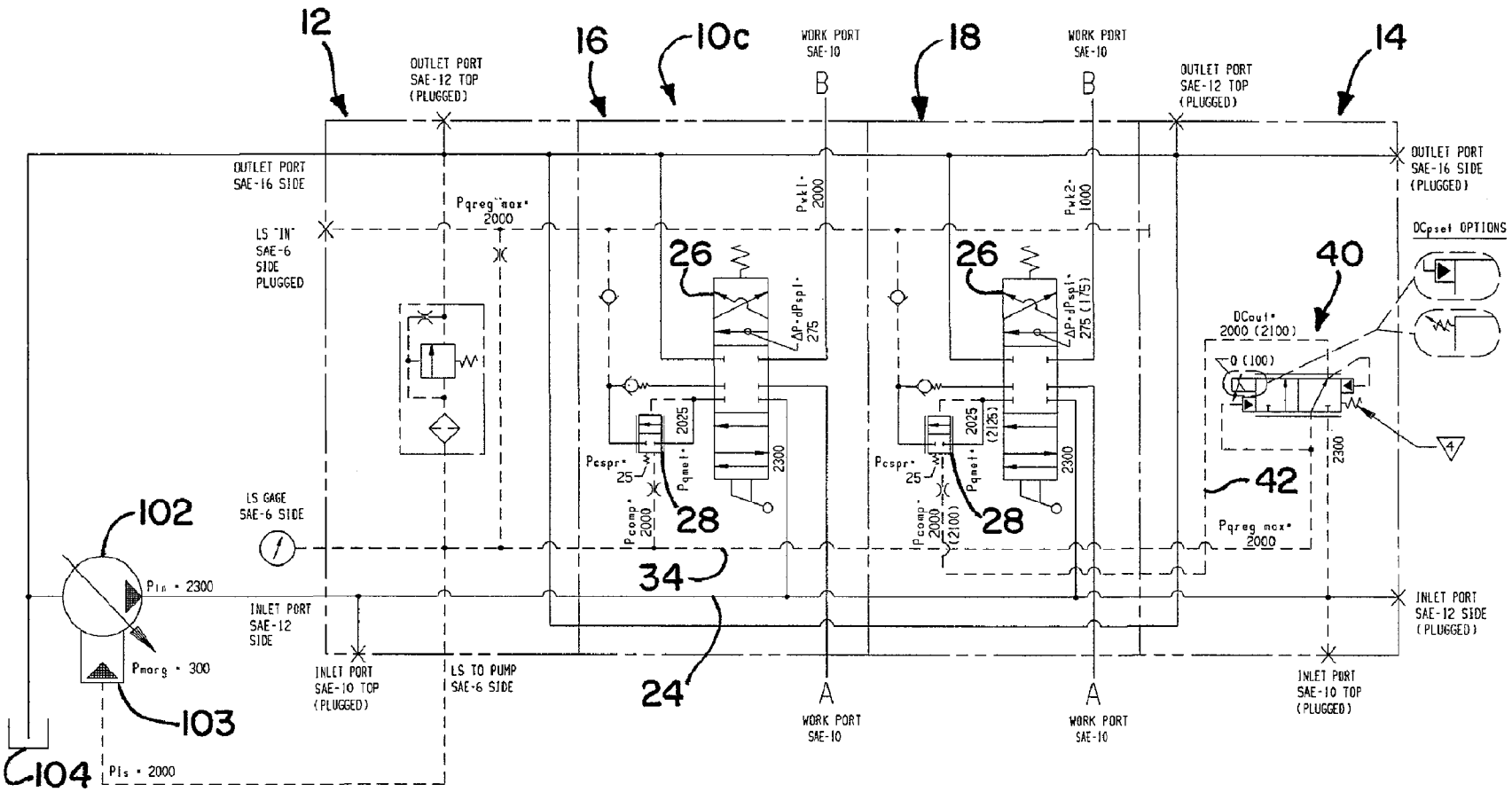
FIG. 4 is schematic diagram showing a further exemplary hydraulic system according to the present invention, where the differential pressure controller is used to boost output flow of one or more of the work sections with high differential pressure default.

FIG. 4 illustrates a further embodiment of a valve assembly 10*c* constructed in accordance with the present invention. The valve assembly 10*c* is the same as FIG. 3 except as noted below or is otherwise evident from the figure. In FIG. 4, the output of the control mechanism 40 is not connected to the pump 102. Instead, the control port 103 of the pump 102 receives the load sense signal via a load sense port 61 and attempts to maintain an outlet pressure based on its established margin pressure and the load sense signal pressure. The output of the control mechanism 40 is provided to the compensator 28 of working section 18. As a result, the pressure drop associated with working section 18 is decreased and less fluid flows through working section 18 to its associated hydraulically actuated device. The actuation speed of the associated hydraulically actuated device, in turn, slows due to the decreased flow.

Although FIG. 4 illustrates only one working section receiving the boosted (higher pressure) output from the control mechanism 40, any number of working sections may receive this boosted output and any number may not receive the boosted output.

Figure 5:
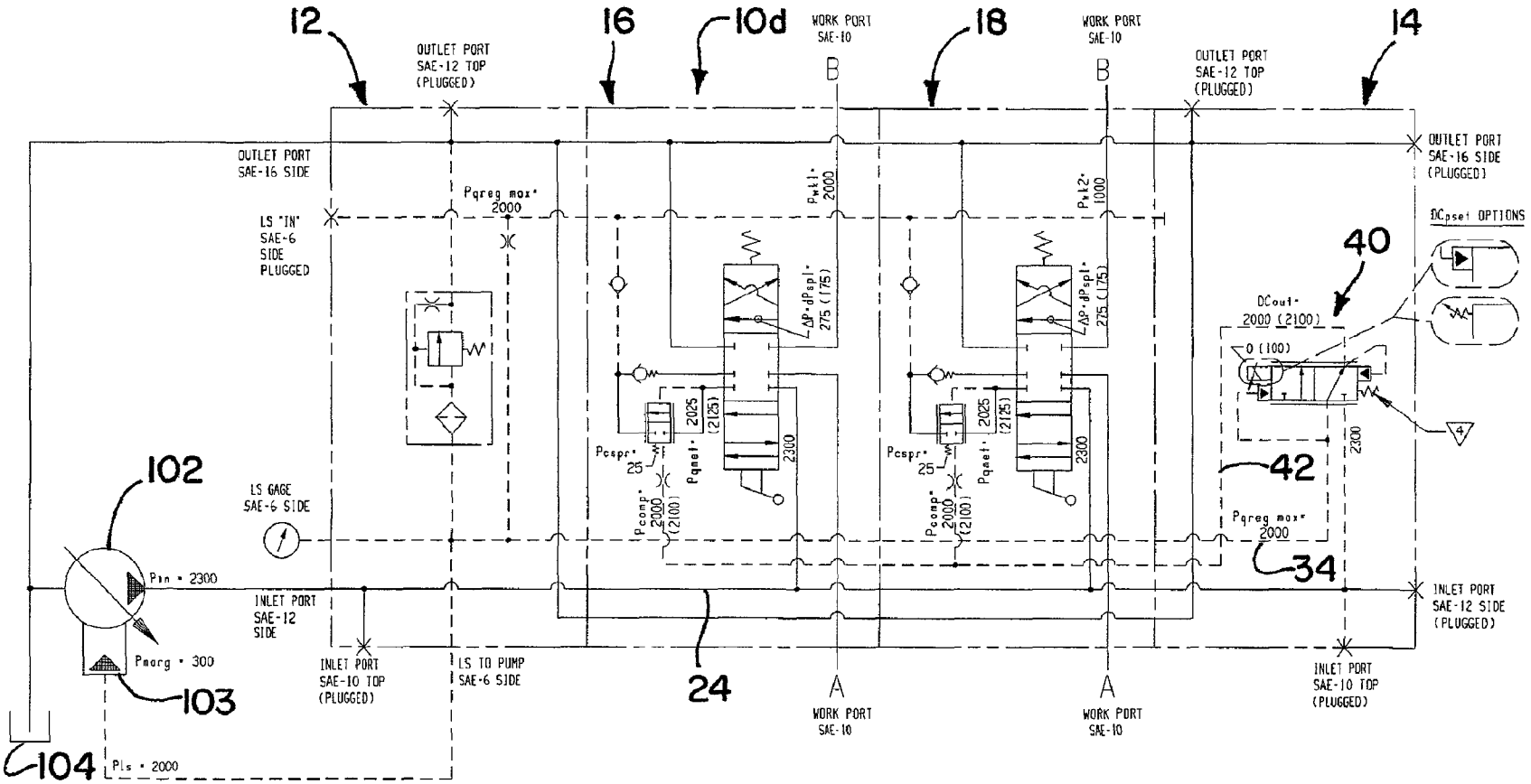
FIG. 5 is schematic diagram showing a still further exemplary hydraulic system according to the present invention, where the differential pressure controller is used to reduce output flow of all work sections with high differential pressure default.

For example, in the valve assembly 10*d* shown in FIG. 5, the boosted output of the control mechanism 40 is provided to both working sections 16 and 18 of the valve assembly 10*e*. The FIG. 5 embodiment is otherwise the same as the FIG. 4 embodiment.

Figure 6:
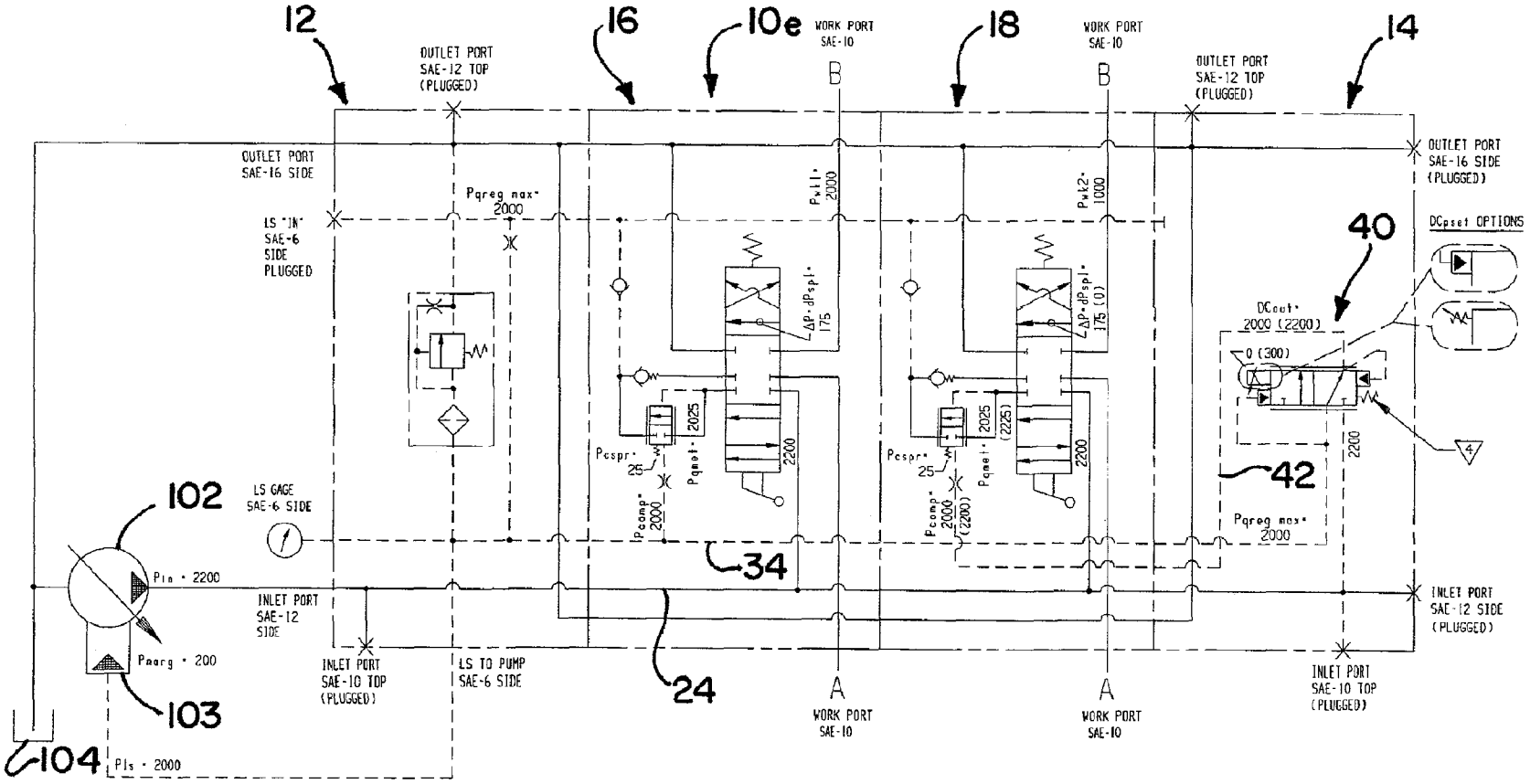
FIG. 6 is schematic diagram showing yet another exemplary hydraulic system according to the present invention, where the differential pressure controller is used to deactivate one or more work sections.

The valve assembly 10*e* of FIG. 6 is similar to that of FIG. 4; however, the control mechanism 40 of FIG. 6 is actuatable for deactivating one of the working sections. Although FIG. 6 illustrates only one working section 18 being deactivated by the boosted output from the control mechanism 40, any number of the working section may receive this boosted output.

As shown in FIG. 6, the boosted output of the control mechanism 40, when activated, is provided to the compensator 28. The boosted output has a pressure sufficient to maintain the compensator 28 in a working section 18 in a closed position. As a result, no fluid flows through the working section 18 and, the hydraulically actuated device is deactivated. The configuration of FIG. 6 may be used, for example, to provide a mode of operation in which one or more functions are deactivated so as to prevent accidental actuation. Such mode may be useful during, for example, towing a vehicle.

The control mechanism 40 can also be used to provide a programmed damping mode by providing automatic cylinder speed ramp-down near the end of stroke, thereby extending the component and overall machine life. That is, cylinder movement can be gradually or quickly slowed near the end of stroke to prevent hard impact. This can be effected by varying the control input to the control mechanism 40 such as by means of a proportional control. In the FIGS. 1-3 embodiments, the control mechanism 40 can be converted from an energized to a de-energized state near the end of stroke of a piston-cylinder assembly, or from a de-energized state to an energized state in the FIGS. 4 and 5 embodiments. Proportional control of the control mechanism 40 can be used to change other dynamics of the valve assemblies 10, 10*a*, . . . and/or the associated systems, as may be desired.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A hydraulic control valve assembly comprising plural control valves each having a variable metering orifice through which hydraulic fluid flows between an inlet port providing for connection to a load sense margin pressure source and a respective work port providing for connection to a respective actuator;

a compensator that receives flow of fluid from the variable metering orifice and directs it to the work port of each control valve in response to a differential in pressures acting on opposite first and second sides of the compensator, wherein the first side receives a pressure at the downstream side of the variable metering orifice;

a load sense passage connected to the control valves to provide a load sense pressure corresponding to the greatest pressure amongst the work ports; and a differential pressure controller having a first inlet connected to the inlet port and a second inlet connected to the load sense passage, the differential pressure controller having a first operational mode in which load sense pressure at the second inlet is supplied to an outlet of the differential pressure controller and a second operational mode in which flow from the first inlet is metered to the outlet of the differential pressure controller to provide a differential control output pressure at the outlet of the differential pressure controller, and wherein the outlet of the differential pressure controller is connected to (a) a control port to which can be connected the control port of the load sense margin pressure source that produces an output pressure of the source that is a predefined amount greater than the pressure supplied to the control port of the source, and/or (b) the second side of the pressure compensating valve of at least one of the plural control valves.

2. The hydraulic control valve assembly according to claim 1, wherein each control valve has a respective compensator, and each compensator that is not connected to the outlet of the differential pressure controller, has the second side connected to load sense passage.

3. The hydraulic control valve assembly according to claim 1, wherein differential pressure controller is configured to provide a differential control output pressure that is greater than the load sense pressure.

4. The hydraulic control valve assembly according to claim 1, wherein the differential pressure controller includes a controller valve that in the second operational mode provides a pressure drop corresponding to a control force applied to the controller valve.

5. The hydraulic control valve assembly according to claim 1, wherein the control force is selected to provide a predetermined pressure difference between the differential control output pressure and the load sense pressure.

6. The hydraulic control valve assembly according to claim 1, including a control device for providing the control force.

7. The hydraulic control valve assembly according to claim 6, wherein the control device is a solenoid, proportional solenoid, hydraulic or pneumatic pressure source, adjustable spring mechanism, stepper motor, bi-directional pilot valve, or similar device.

8. The hydraulic control valve assembly according to claim 1, wherein the control device is configured to provide different control forces during shifting of the differential pressure controller between its first and second operation modes.

9. The hydraulic control valve assembly according to claim 1, wherein the controller valve is biased to a position corresponding the first operation mode.

10. The hydraulic control valve assembly according to claim 1, wherein the outlet of the differential pressure controller is connected to the control port via a pressure gain mechanism that operates in one position to restrict flow greater than in a second position.

11. The hydraulic control valve assembly according to claim 1, wherein the differential pressure controller in the second operational mode supplies to its outlet a pressure higher than the load sense pressure, whereby the control valves that have the compensators thereof receiving the outlet pressure of the differential pressure controller will have the flow output reduced.

12. The hydraulic control valve assembly according to claim 1, wherein the differential pressure controller in the second operation mode increases pressure on the second side of the pressure compensating valve while the inlet port pressure is unchanged to stop output flow of is used to deactivate one or more work sections respectively associated with the control valves.

13. The hydraulic control valve assembly according to claim 1, wherein the differential pressure controller in the second operation mode increases the inlet port pressure while pressure on the second side of the pressure compensating valve is unchanged is used to boost output flow of one or more work sections respectively associated with the control valves.

14. The hydraulic control valve assembly according to claim 1, wherein the differential pressure controller in the second operation mode increases pressure on the second side of the pressure compensating valve while the inlet port pressure is unchanged is used to reduce output flow of one or more work sections respectively associated with the control valves.

15. The hydraulic control valve assembly according to claim 1, wherein the differential pressure controller is used to reduce the responsiveness of one or more work sections respectively associated with the control valves.

16. A hydraulic control system comprising a hydraulic control valve assembly according to claim 1, a pump connected to the inlet port, and an actuator connected to the work port of a respective control valve.

17. An excavator comprising a hydraulic control system according to claim 16.

18. A method of controlling a hydraulic system wherein plural control valves each have a variable metering orifice through which hydraulic fluid flows between an inlet port providing for connection to a pump and a respective work port providing for connection to a respective actuator, comprising the steps of:

using a compensator to control flow of fluid from the variable metering orifice to the work port of each control valve in response to a differential in pressures acting on opposite first and second sides of the compensator, wherein the first side receives a pressure at the downstream side of the variable metering orifice;

providing a load sense pressure corresponding to the greatest pressure amongst the work ports; and using a differential pressure controller having a first inlet connected to the pump supply port and a second inlet connected to the load sense passage, the differential pressure controller having a first operational mode in which load sense pressure at the second inlet is supplied to an outlet of the differential pressure controller and a second operational mode in which flow from the first inlet is metered to the outlet of the differential pressure controller to provide a differential control output pressure at the outlet of the differential pressure controller, and wherein the outlet of the differential pressure controller is connected to (a) a pump control port to which can be connected the control port of a variable displacement pump that produces an output pressure of the pump that is a predefined amount greater than the pressure supplied to the control port of the pump, and/or (b) the second side of the pressure compensating valve of at least one of the plural control valves.

19. A valve assembly comprising:

multiple working sections, each working section having a movable control spool and a compensator downstream of an inlet of the control spool, an input conduit for supplying fluid to the working sections, a load sense conduit adapted to receive a pressure signal from the working section outputting a highest pressure, and a control mechanism connected to the input conduit and the load sense conduit and provide an output pressure in response to a fixed setting or variable input actuation of an associated input.

20. The valve assembly of claim 19, wherein the associated input is a proportional solenoid.

21. The hydraulic control valve assembly according to claim 1, wherein the pressure source includes a variable displacement pump.

* * * * *